United States Patent [19]

O'Mahoney

[11] Patent Number: 4,839,555

[45] Date of Patent: Jun. 13, 1989

[54] LAMINATED LIGHTING DEVICE

[76] Inventor: Patrick J. O'Mahoney, 18717 Nathans Place, Gaithersburg, Md. 20708

[21] Appl. No.: 85,541

[22] Filed: Jul. 8, 1987

Related U.S. Application Data

[63] Continuation of Ser. No. 862,795, May 13, 1986, abandoned.

[51] Int. Cl.[4] ..... H01J 5/22; H01J 9/26; H01J 61/36

[52] U.S. Cl. ..... 313/493; 313/573; 313/634; 445/25

[58] Field of Search ..... 313/493, 573, 634; 445/24, 25

[56] References Cited

U.S. PATENT DOCUMENTS

| | | | |
|---|---|---|---|
| 3,425,988 | 2/1969 | Gorman | 260/45.95 |
| 3,919,452 | 11/1975 | Ettre et al. | 445/25 X |
| 4,504,766 | 3/1985 | Kaneko | 313/634 |
| 4,584,501 | 4/1986 | Cocks et al. | 313/493 |

*Primary Examiner*—Kenneth Wieder

*Attorney, Agent, or Firm*—Cushman, Darby & Cushman

[57] ABSTRACT

A laminated lighting device and a method of manufacturing the device are described. The device comprises layers of a glass having at least one channel formed therein. A vapor such as neon fills each channel, and each channel has a pair of electrodes to excite the vapor in order to emit light.

22 Claims, 2 Drawing Sheets

FIG. 1
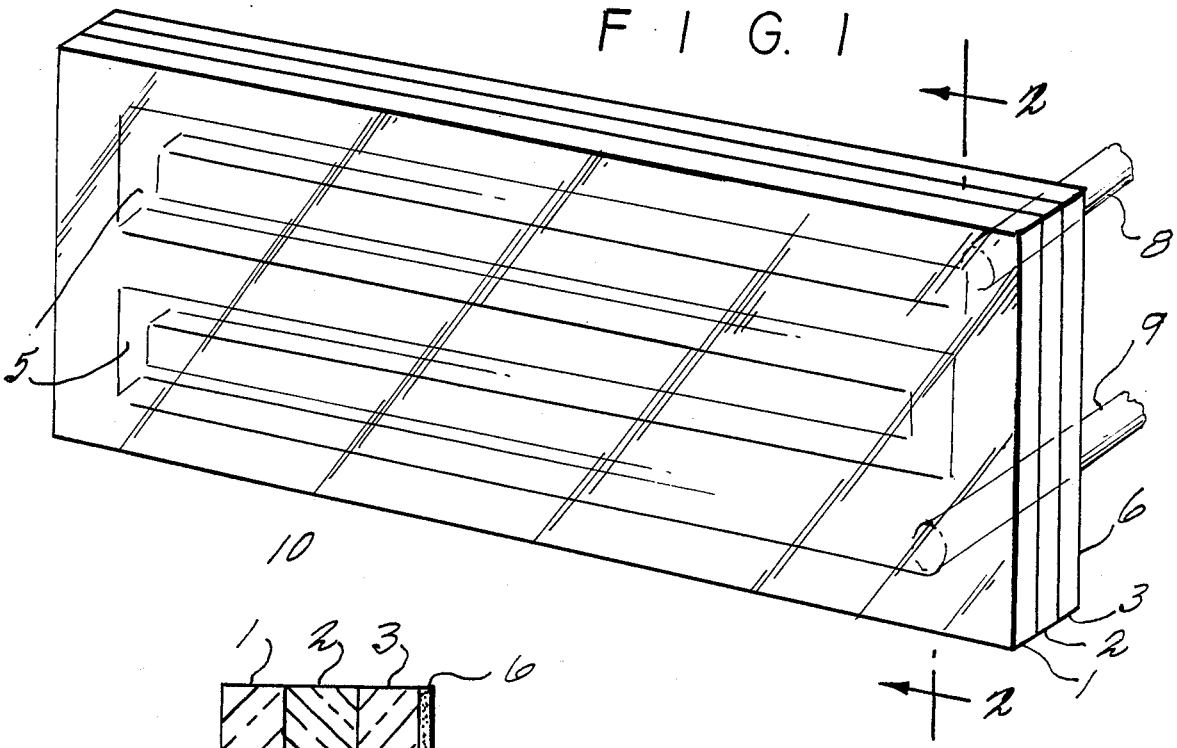
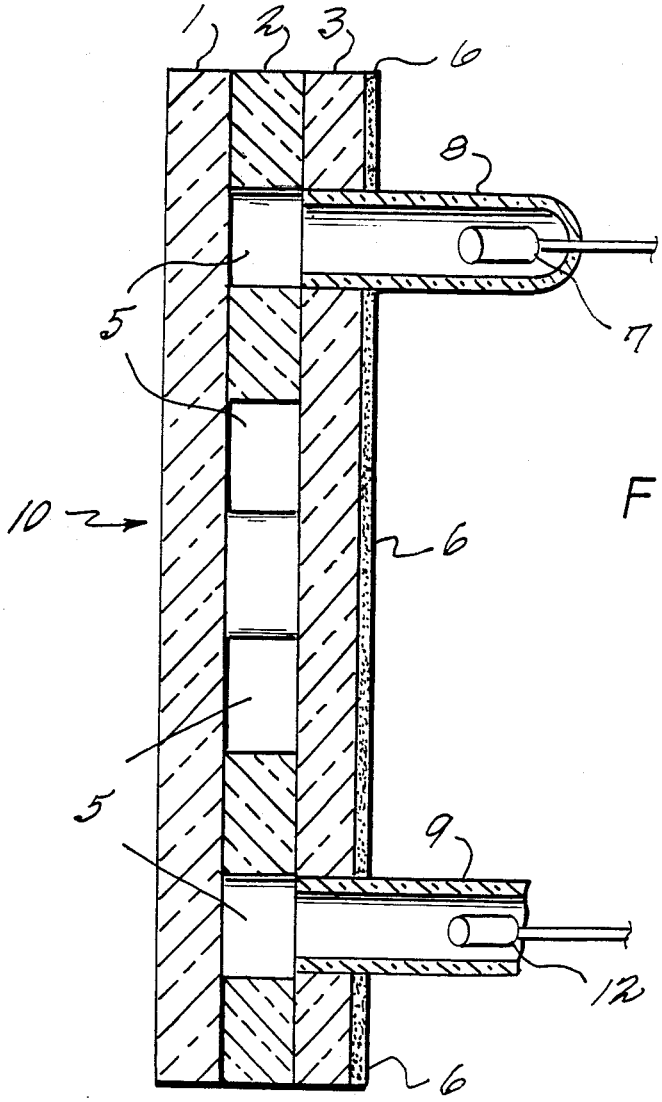
FIG. 2

LAMINATED LIGHTING DEVICE

This is a continuation of application Ser. No. 862,795, filed May 13, 1986, which was abandoned upon the filing hereof.

This invention generally relates to lighting devices. In particular, it provides a simple yet radically different light emitting device and method for producing such a device, wherein the lighting design is no longer limited to delicate and difficult to produce glass tubes or moldings, but rather may be formed in sturdy light fixtures made of transparent layers of glass.

BACKGROUND OF THE INVENTION

Lighting fixtures utilizing tube or molded glass containing neon other light emitting vapors are common in the prior art. U.S. Pat. No. 2,089,567 describes neon fixtures made from molded glass panels which may be large panels or compartments and may further contain standard neon tubing to produce fixtures of contrasting colors. It details the necessity of using a fixture which can withstand the high pressures on the exterior of such a fixture because of the relative vacuum within. These panels can be partitioned and have arched glass faces in order to resist external atmospheric pressure.

U.S. Pat. No. 2,102,049 describes a neon fixture whereby the use of fragile glass tubing is avoided by introducing the gas into channels sealed in molded glass. The channels can be molded in such a way that lighting is provided over a broad surface.

Both of these references, while avoiding fragile standard neon tubes, still require members of molded glass. Molding glass requires extreme care and high temperatures to produce fixtures of uniform wall thickness which are fully sealed.

SUMMARY OF THE INVENTION

An object of this invention is to provide relatively sturdy light emitting devices which can be manufactured from layers of glass or other transparent materials.

Another object of the invention is to provide a method for manufacturing light emitting devices without the use of high temperatures necessary for molding glass or sealing by molding.

The present invention relates to a lighting device composed of layers of glass or other transparent materials laminated together using an adhesive. An interior surface of one or more of the layers of the device is cut so as to form one or more channels. Each channel is filled with a vapor capable of light emission. At least two electrodes are placed in each channel in order to cause light emission from the vapor. The present invention also relates to the process of making the lighting device.

These as well as other objects and advantages of this invention will be better understood by careful study of the following detailed description of the presently preferred exemplary embodiments of this invention, taken in conjunction with the accompanying drawings, of which:

BRIEF DESCRIPTION OF THE DRAWINGS

FIG. 1 is a perspective view of a preferred embodiment of the laminated lighting device;

FIG. 2 is a side view generally depicting the glass layers and electrode components of a preferred embodiment, taken along line 2—2 of FIG. 1.

DETAILED DESCRIPTION OF THE INVENTION

Figure 3:
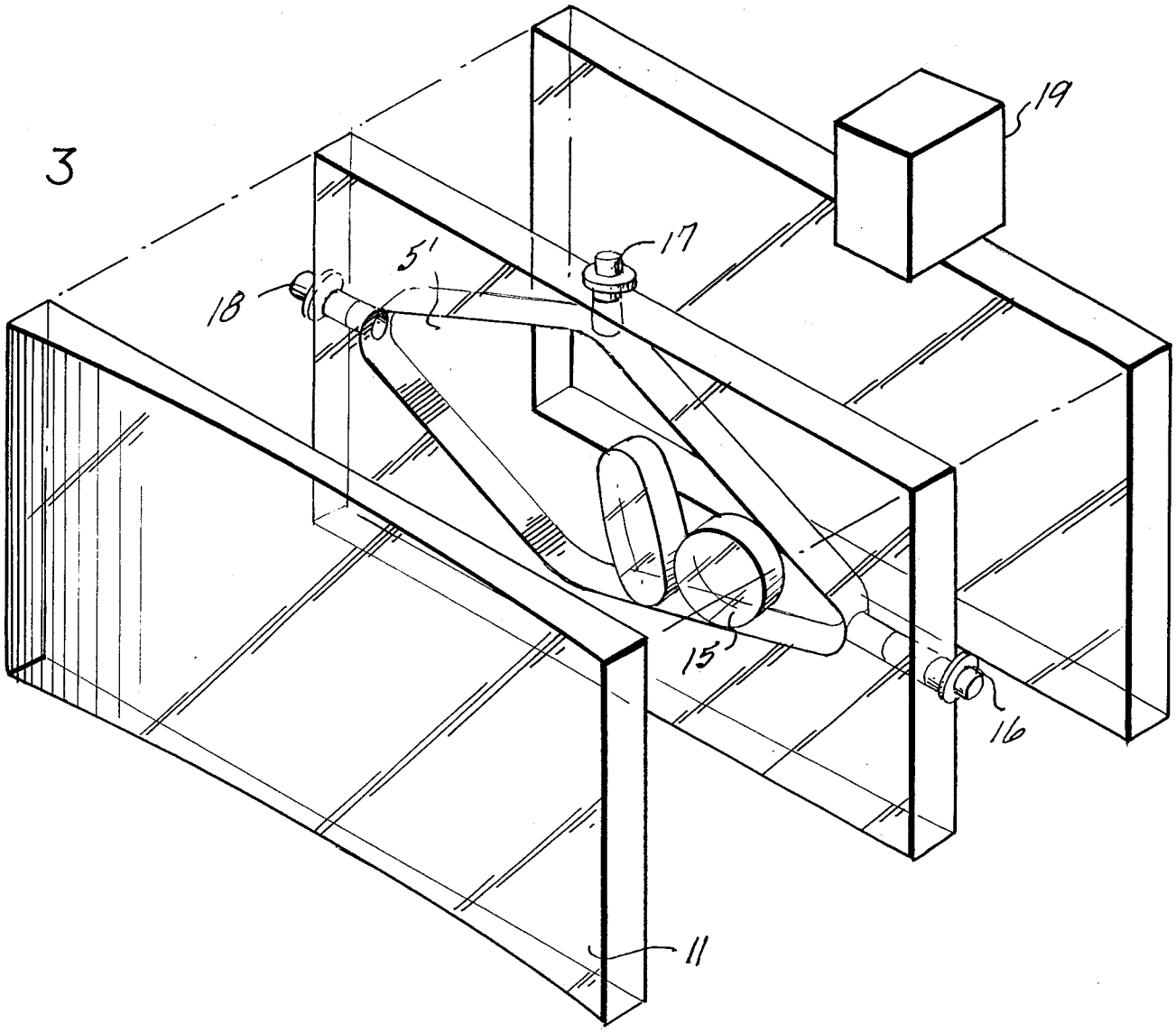
FIG. 3 is an exploded view of another embodiment of the invention.

In the present invention, I have found a simple and sturdy construction for a light fixture which avoids fragile glass tubing and expensive molding techniques.

Importantly, no molding or bending of glass or use of heat sources normally needed to produce neon tube type lights, are required by the instant invention, since the light is produced from a cavity formed by the lamination of glass layers or other transparent materials. Because no heating to temperatures necessary to mold glass, or cooling is required, the channel cavity defined within the glass layer composite of the invention may be cut in a variety of shapes and designs to extremely fine tolerances.

An exemplary embodiment is shown in FIGS. 1 and 2. It generally includes a fixture 10 comprised of glass layers 1, 2 and 3, wherein layer 2 is etched or otherwise cut to form a continuous channel cavity 5. The rear surface of layer 3 can optionally be mirrored with layer 6 shown in FIG. 2.

Electrodes 7 and 12 are introduced into connector tubes 8 and 9 respectively and are arranged to be connected to an external power source (not shown). Vapor capable of light emission is contained in cavity 5. Transparent adhesive (not shown) is applied to fully seal the cavity 5.

Upon electrification, the vapor in the cavity 5 emits light, thus lighting the design cut into glass layer 2.

The center layer can be cut or etched completely through its thickness. When two outer layers 1 and 3 sandwich the center layer 2, a continuous channel cavity 5 is formed within the laminate. The glass used in the invention may be cut in any way appropriate, such as by hand cutting, sand blasting or hydraulic cutting, or any other method whereby a continuous channel cavity 5 is formed upon subsequent lamination of the glass layers.

Access holes which create a passage from the continuous channel cavity 5 to outside the device, permit a vapor such as neon to be introduced into the continuous channel cavity. The access holes can also be used to eliminate impurities from the channel after the layers have been laminated, e.g. solvent can be pumped through the channel to remove excess adhesive. Impurities can be removed by a high temperature neon bombardment heat treatment (in which case the materials used in the device must be capable of withstanding the bombardment temperature), or by other methods for eliminating impurities from glass containers.

In another embodiment, the layers are sealed without access holes, sealing in the vapor capable of light emission. In this case, electrodes are sealed within the channel (with or without a conductive lead extending to the outside surface), or means for applying electrical power to the vapor are external to the lighting device.

The layers are made from transparent materials, advantageously materials which are low expansion and heat resistant such as borosilicate glass, e.g. Pyrex glass.

The continuous channel cavity 5 acts as a current path during operation of the device. Electrodes 7 and 12 are inserted in the channel cavity. In a preferred embodiment, connector tubes 8 and 9 are sealed to the access holes cut in an outer layer, so that when electrodes 7 and 12 are introduced into the connecting tubes, an electrode to electrode continuous current path is formed. With this arrangement, the electrodes 7 and 12 are mounted on the rear of the fixture and thus do not interfere with the view of the light design. Alternatively, plugs 16, 17, 18 containing electrodes can seal channel 5' (see FIG. 3).

In any embodiment, the lighting fixture must be fully sealed so that the vapor capable of light emission cannot be diluted or escape.

The adhesive used to seal the layers of the device should be capable of bonding porous rigid materials such as glass, should be transparent and non-conductive and advantageously should be capable of withstanding high temperatures. Further the adhesive selected should be capable of sealing the layers without giving off vapor which would interfere with the lighting means. The adhesive which has been most successful is the Locktite 312 sealant sold by the Locktite Corporation of Newington, Conn. Locktite 312 is made in accordance with Gorman U.S. Pat. No. 3,425,988, the entire disclosure of which is hereby incorporated as reference and relied upon. The sealant according to Gorman is a polymerizable polyacrylate anaerobic sealant composition containing an acrylate terminated monomer and a peroxy polymerization initiator. The monomer is the reaction product of an organic polyisocyanate and an acrylate ester.

The adhesive is used at all points where leakage could occur. It is used in laminating the layers together, and it can be used to seal the connector tubes to the glass layer at the access holes. Finally, it can be used to seal the electrodes in the connecting tubes.

Advantageously the adhesive chosen should be capable of use at room temperature. In a preferred method of constructing the lighting device, no heating or cooling of the glass plates or tubes is required, minimizing the possibility of breaking or cracking the fixture during manufacture.

After the layers have been laminated, a solvent can be pumped through the channels to eliminate excess adhesive.

Various vapor lighting means (utilizing the vapor discharge effect) can be used to produce unique and startling optical effects. For example, use of sodium vapor, mercury vapor or a noble gas such as neon, argon, xenon, etc., allow lights of various colors to be produced. Further, the inner wall of the channel 5 can be coated with a material which fluoresces (as in a fluorescent tube).

In another embodiment, the device may comprise many layers, with multiple distinct channels within the laminate. In this embodiment, different lighting means such as different vapors, producing different colors, may be used in a single display, each channel separately sealed and provided with its own electrodes. A single channel 5' can have plugs containing electrodes 16, 17, 18 as shown in FIG. 3 and means (not shown) permitting controlled shifting of the current via the multiple electrodes in the channel 5' (see FIG. 3).

In another embodiment of the invention, one or more pieces 15 of glass or other materials of various possible shapes are inserted into the continuous channel cavity 5' (see FIG. 3). The pieces of glass, which can be fixed, or movable by means such as a external magnet 19, cause interesting optical effects. If the magnet 19 is used to move the pieces of glass, the pieces must be treated so as to respond to the movement of the magnet 19 (see FIG. 3).

The laminated lighting device can be constructed and displayed in a number of configurations. Not only are finely detailed two dimensional designs possible with this invention, but figures of three dimensional character are possible by laminating glass layers wherein the internal plates are cut in such manner that single or multiple internal current and lighting paths pass toward and away from the viewer, as well as side to side.

In another embodiment of the invention, only two layers of glass are used, and one is etched, cut or sand blasted in such a manner that a channel is formed that does not pass through the full thickness of the glass. The two plates may then be laminated together forming a cavity into which vapor is pumped and in which electrodes are sealed.

The great number of embodiments of this invention allow for a wide variety of applications. Because of the stability of the device, it may be used as a window or window display, or placed against any supporting wall. It can be used as a table top, or combined or modified to create a sculpture of light. Where it is preferred that the light be visible from one side only, such as when mounted upon a supporting wall, the rear glass layer may be coated with a reflective, mirror-like surface 6.

The transparent layers can be colored glass, glass formulated to have filtering effects and/or textured glass. Polished granite or other non-transparent materials can be substituted for the rear layer of the lighting device. Also parts of the outer surface can be painted. Layers forming lenses 11, e.g., having a concave shape, can also be used (see FIG. 3).

The external surfaces of the lighting device can also have a coating, such as an acrylic coating to protect the device from being damaged or chipped.

As should now be appreciated, although only one exemplary embodiment of the invention has been described in detail, those skilled in the art will recognize that many modifications and variations may be made in this embodiment while yet retaining many of the novel features and advantages of this invention. Accordingly, all such variations and modifications are intended to be included within the scope of the appended claims.

What is claimed is:

1. A laminated lighting device comprising:

a base layer having an external lower surface and an internal upper surface;

a second layer disposed above said base layer, having an external upper surface and an internal lower surface;

an adhesive sealingly contacting said internal lower surface of said second layer with said internal upper surface of said base layer, said adhesive being capable of bonding porous rigid materials, is transparent and non-conductive and capable of withstanding high temperatures, and capable of sealing the layers without giving off vapor which would interfere with the lighting device;

wherein at least one of said internal upper surfaces and said internal lower surface has at least one channel formed therein, each channel forming at least one opening in said device; and vapor lighting means, in each channel, for emitting light in response to electrical power applied thereto.

2. A device as in claim 1 further comprising electrode means including at least two electrodes in said channel, for applying electrical power to said vapor lighting means.

3. A laminated lighting device as in claim 1, wherein said layers comprise glass.

4. A laminated lighting device as in claim 1, wherein said adhesive is a polymerizable polyacrylate anaerobic sealant composition containing an acrylate terminated monomer and a peroxy polymerization initiator.

5. A laminated lighting device as in claim 1, wherein said vapor lighting means is selected from the group consisting of noble gases, mercury vapor and sodium vapor.

6. A laminated lighting device as in claim 1, wherein said second layer is transparent.

7. A laminated lighting device comprising:

a base layer having an external lower surface and an internal upper surface;

an intermediate layer disposed above said base layer having an upper surface and a lower surface, said intermediate layer having at least one channel formed therein, each channel forming at least one opening in said device;

a top layer having an external upper surface and an internal lower surface;

an adhesive sealingly contacting said upper surface of said base layer with said lower surface of said intermediate layer, and said upper surface of said intermediate layer with said lower surface of said top layer, said adhesive being capable of bonding porous rigid materials, is transparent and non-conductive and capable of withstanding high temperatures, and capable of sealing the layers without giving off vapor which would interfere with the lighting device;

vapor lighting means in each channel, for emitting light in response to electrical power applied thereto.

8. A device as in claim 7 further comprising electrode means including at least two electrodes in said channel, for applying electrical power to said vapor lighting means.

9. A laminated lighting device as in claim 7, wherein said layers comprise glass.

10. A laminated lighting device as in claim 7, wherein said adhesive is a polymerizable polyacrylate anaerobic sealant composition containing an acrylate terminated monomer and a peroxy polymerization initiator.

11. A laminated lighting device as in claim 7, wherein each channel has a depth equal to the thickness of said intermediate layer.

12. A lighting device as in claim 7, wherein said vapor lighting means is selected from the group consisting of noble gases, mercury vapor and sodium vapor.

13. A laminated lighting device as in claim 7, wherein said top layer and said intermediate layer are transparent.

14. A laminated lighting device as in claim 7, wherein said at least one opening is in said base layer.

15. A laminated lighting device as in claim 7, wherein said device comprises three or more layers wherein at least one of said layers has a channel formed therein.

16. A method of manufacturing a laminated lighting device comprising the steps of:

forming at least one channel design in a first layer of transparent material;

sealing said first layer to at least one other layer so as to form at least one channel having at least one external opening with an adhesive capable of bonding porous rigid materials, is transparent and non-conductive and capable of withstanding high temperatures, and capable of sealing the layers without giving off vapor which would interfere with the lighting device; and introducing a vapor capable of light emission into said channel.

17. A method as in claim 16 wherein, said forming step comprises the step of forming in said first layer at least one continuous channel design wherein each channel design has a depth equal to the thickness of said first layer.

18. A method as in claim 16 wherein said at least one channel design does not extend the full thickness of said first layer.

19. A method as in claim 16, wherein said at least one channel design is formed by etching.

20. A method as in claim 16, wherein said vapor capable of light emission is a selected from the group consisting of noble gases, sodium vapor and mercury vapor.

21. A method as in claim 16, further comprising after the sealing step, removing excess adhesive from said channel.

22. A method as in claim 16, further comprising inserting at least one or two electrodes in said channel.

* * * * *